US005340257A

United States Patent [19]

Morassutti

[11] Patent Number: 5,340,257

[45] Date of Patent: Aug. 23, 1994

[54] ACCESSORY SPACING ELEMENT FOR DOWEL ANCHORING DEVICES FOR WALL COVERING SLABS

[75] Inventor: Paolo Morassutti, Padua, Italy

[73] Assignee: Fischer Italia S.a.s. di Paolo Morassutti & C., Padua, Italy

[21] Appl. No.: 934,433

[22] PCT Filed: Jan. 15, 1992

[86] PCT No.: PCT/EP92/00074

§ 371 Date: Sep. 14, 1992

§ 102(e) Date: Sep. 14, 1992

[87] PCT Pub. No.: WO92/13154

PCT Pub. Date: Aug. 6, 1992

[30] Foreign Application Priority Data

Jan. 18, 1991 [IT] Italy ..... PD91U000004

[51] Int. Cl.[5] ..... F16B 21/00

[52] U.S. Cl. ..... 411/512; 411/73; 411/182; 52/698

[58] Field of Search ..... 52/698, 745.21; 411/15, 411/55, 41, 44, 508, 43, 182, 34, 71, 45, 436, 437, 38, 73, 180, 186, 512, 918

[56] References Cited

U.S. PATENT DOCUMENTS

| | | | |
|---|---|---|---|
| 3,280,875 | 10/1966 | Fischer | 411/180 |
| 3,593,612 | 7/1971 | Schulze | 411/15 |
| 4,274,324 | 6/1981 | Giannuzzi | 411/15 X |
| 4,340,330 | 7/1982 | Reidel | 411/34 X |
| 4,478,545 | 10/1984 | Mizusawa et al. | 411/182 X |
| 4,642,009 | 2/1987 | Fischer | 411/71 X |
| 4,668,145 | 5/1987 | Hirohata | 411/45 X |
| 4,776,737 | 10/1988 | Wollar | 411/38 |
| 4,861,208 | 8/1989 | Boundy | 411/339 |

FOREIGN PATENT DOCUMENTS

| | | | |
|---|---|---|---|
| 3005565 | 8/1981 | Fed. Rep. of Germany | 411/38 |
| 3634679 | 4/1988 | Fed. Rep. of Germany . | |
| 1315418 | 12/1962 | France | 411/71 |
| 2453950 | 11/1980 | France . | |
| 45-34333 | 11/1970 | Japan | 411/38 |
| 674865 | 7/1990 | Switzerland . | |

*Primary Examiner*—Rodney M. Lindsey

*Attorney, Agent, or Firm*—Guido Modiano; Albert Josif; Daniel O'Byrne

[57] ABSTRACT

The accessory spacing element for dowel anchoring devices for wall covering slabs includes a tubular body made of plastic material which is interposed between the dowel and the respective accommodation seat of the slab. The body has an elastically deformable frustum-shaped annular flange at one end thereof.

7 Claims, 1 Drawing Sheet

ACCESSORY SPACING ELEMENT FOR DOWEL ANCHORING DEVICES FOR WALL COVERING SLABS

BACKGROUND OF THE INVENTION

The present invention relates to an accessory spacing element for dowel anchoring devices for wall covering slabs.

It is currently common to cover walls with slabs, generally made of marble, which are associated with said walls by means of various types of anchorings which are fixed by means of screw anchors.

One type of these anchoring devices comprises a bracket which is fixed to the wall by means of a screw anchor and which supports an internally threaded tubular element inside which a complementarily threaded pivot is screwed; said pivot protrudes with a flattened end which is arranged conveniently parallel to the floor.

Said flattened end is crossed by a hole in which a dowel is inserted.

During the installation of the slabs, said flattened end is arranged between the edges of two consecutive slabs, and the dowel is inserted with both of its ends in adapted holes of said slabs, engaging them.

The arrangement of the assembly must be performed so that the device, by means of the flattened end of the threaded pivot, bears the vertical load transmitted by the slab arranged above it and acts as a horizontal retainer for the lower slab.

Due to this reason, the upper slab rests on the flattened end, whereas a certain play is left between said flattened end and the lower plate.

This causes difficulties in correctly mutually aligning the various slabs and in providing constant-width gaps.

SUMMARY OF THE INVENTION

The aim of the present invention is to make the installation of wall covering slabs easier, more rapid and precise.

A consequent primary object is to provide an accessory spacing element which can be applied without difficulty to known dowel devices for anchoring wall covering slabs.

Another important object is to provide an accessory spacing element which allows perfect alignment of the slabs and the provision of constant-width gaps without requiring measurement and adjustment operations.

Still another object is to provide an accessory spacing element which can be manufactured easily and has a low cost.

This aim, these objects and others which will become apparent hereinafter are achieved by an accessory spacing element for dowel anchoring devices for wall covering slabs, characterized in that it comprises a tubular body made of plastic material to be interposed between the dowel and the respective accommodation seat of the slab, said body having, at one end, an elastically deformable frustum-shaped annular flange.

BRIEF DESCRIPTION OF THE DRAWINGS

Further characteristics and advantages of the present invention will become apparent from the detailed description of an embodiment thereof, illustrated only by way of non-limitative example in the accompanying drawings, wherein.

DESCRIPTION OF THE PREFERRED EMBODIMENTS

Figure 1:
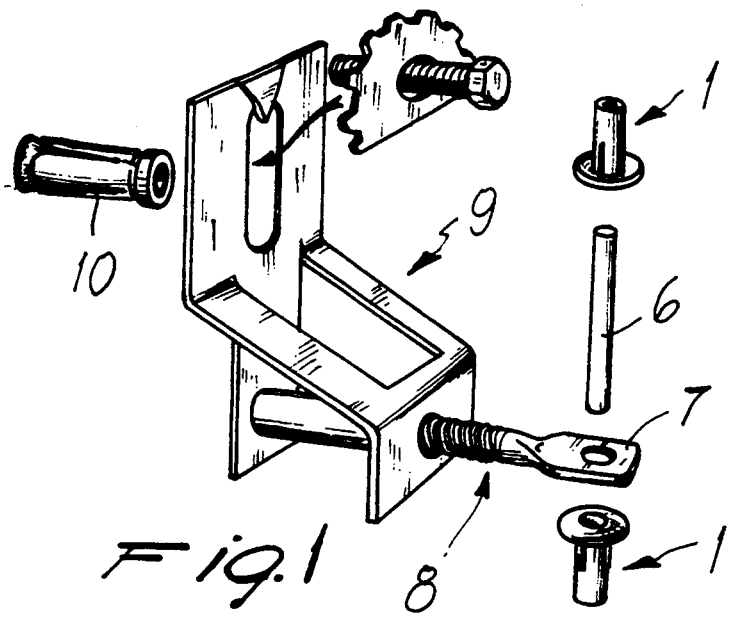
FIG. 1 is a perspective view of a dowel anchoring device with accessory spacing elements according to the invention.
Figure 2:
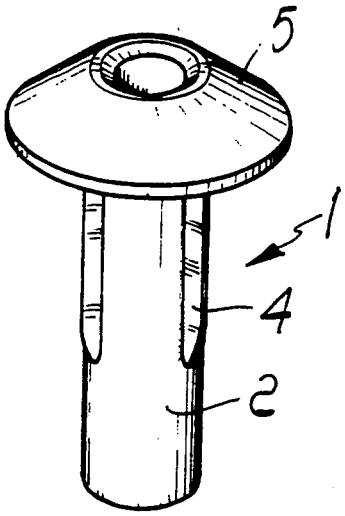
FIG. 2 is a perspective view of the accessory spacing element according to the invention.

With reference to the above figures, the accessory spacing element according to the invention is generally designated by the reference numeral 1 and comprises a tubular cylindrical body 2 made of plastic material which is internally and externally provided with longitudinal wings, respectively 3 and 4, which extend respectively from the median region to one end and from the median region to the opposite end.

Conveniently, said wings 3 and 4 have a substantially triangular cross-section.

Said body 2 is provided, at the end at which said external wings 4 end, with a frustum-shaped annular flange 5 which extends toward the opposite end and has characteristics of elastic deformability. More in detail, as clearly illustrated in FIGS. 3 and 4, the tubular cylindrical body 2 of the spacing element 1 has an end 20, an opposite end 21, a median region 22, an internal annular cylinder surface 23 and an external annular cylinder surface 24. The longitudinal wings 3, 4 include four regularly spaced internal longitudinal wings 3*a*, 3*b*, 3*c* and 3*d* connected to the internal annular cylinder surface 23, and four regularly spaced external longitudinal wings 4*a*, 4*b*, 4*c* and 4*d* connected to the external annular cylinder surface 24. As mentioned heretofore, the external longitudinal wings 4*a*, 4*b*, 4*c* and 4*d* extend from the median region 22 of the cylindrical body 2, to the end 20 thereof, and the wings 3*a*, 3*b*, 3*c*, 3*d* extend from the median region 22 to the opposite end 21.

Figure 4:
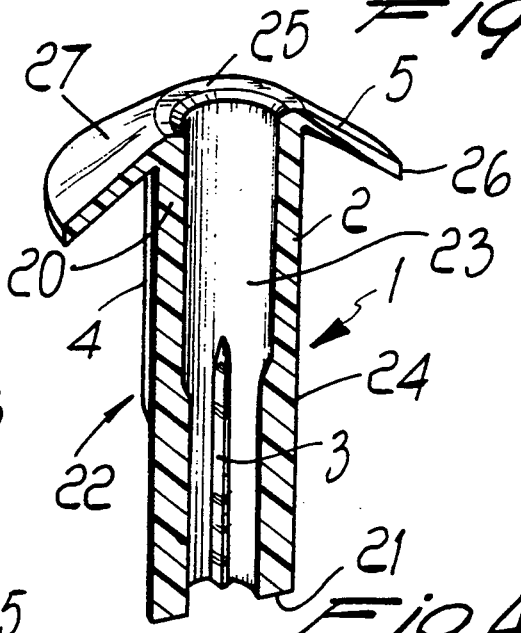
FIG. 4 is a longitudinally sectional perspective view of the element of FIG. 2.
Figure 5:
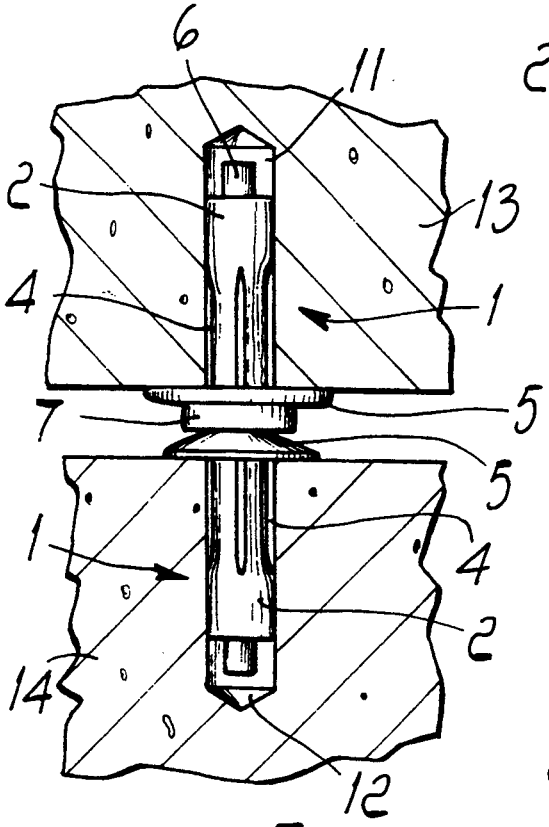
FIG. 5 is a view of the fitting of the anchoring device of FIG. 1.
Figure 3:
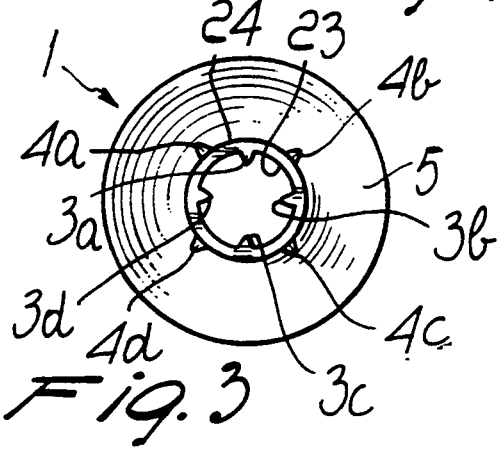
FIG. 3 is a bottom view of the element of FIG. 2.

As also clearly illustrated in FIGS. 3 and 4, the frustum-shaped annular flange 5 extends outwardly from the end 20 at an acute angle with respect to the cylindrical body 2. The frustum-shaped annular flange 5 includes an inner annular edge 25 connected to the end 20 of said cylindrical body, an outer annular edge 26 surrounding a portion of the tubular cylindrical body 2 and the external longitudinal wings 4*a*, 4*b*, 4*c* and 4*d*. The frustum-shaped annular flange 5 also has a substantially planar face 27 extending between the inner annular edge 25 and the outer annular edge 26. The inner annular edge 25 and the outer annular edge 26 are inclined with respect to the substantially planar face 27.

According to the invention, respective ends of a dowel 6 of a known device for anchoring wall covering slabs are insertable into the tubular cylindrical bodies 2 of a pair of said elements 1.

Said dowel 6 is first inserted in a hole which passes through the flattened end 7, arranged parallel to the floor, of a threaded pivot 8 which is screwed on a bracket, generally designated by the reference numeral 9, which is fixed to the wall by means of a screw anchor 10.

The ends of the dowel 6, with the respective elements 1, are then inserted in adapted holes 11 and 12 respectively of an upper slab 13 and of a lower slab 14, usually made of marble or the like.

The two flanges 5 of the elements 1 thus arrange themselves between the flattened end 7 of the pivot 8 and the respective slabs 13 or 14.

The flange 5 of the element 1 which is arranged downward is suitable for constituting a spacer for positioning the flattened end 7 of the pivot 8, and thus the entire anchoring device, on the lower slab.

The flange 5 of the element 1 which is arranged upward, which is flattened due to the weight of the upper slab 13, constitutes a further spacing element for providing gaps between the slabs.

The wings 3 and 4 have the function of improving the grip between the dowel 6, the element 1 and the hole 11 or 12.

The correct installation of the covering slabs is thus facilitated by the presence of the accessory spacing elements according to the invention.

In fact, as previously mentioned, the element 1 arranged on the lower slab 14 with its flange 5 constitutes an element for the support and abutment, at a preset distance from said slab, of the flattened end 7 of the threaded pivot 8 and consequently of the screw anchor 10 which supports the bracket 9 and the entire anchoring device.

The element 1 arranged on the upper slab is instead used to complete the spacing between the slabs, providing gaps having a constant and preset width.

In practice it has thus been observed that the accessory spacing element according to the invention has achieved the intended aim and objects.

In practice, the materials employed, so long as compatible with the contingent use, as well as the dimensions, may be any according to the requirements.

I claim:

1. Spacing element for dowel anchoring devices for fixing covering slabs to walls, said spacing element comprising;

a tubular cylindrical body made of plastic material and defining one end, an opposite end, a median region, an internal annular cylinder surface and an external annular cylinder surface;

external longitudinal wings connected to said external annular cylinder surface and extending from said median region to said one end;

internal longitudinal wings connected to said internal annular cylinder surface and extending from said median region to said opposite end;

a frustum-shaped annular flange extending outwardly from said one end at an acute angle with respect to said cylindrical body, said frustum-shaped annular flange including an inner annular edge connected to said one end of said cylindrical body, an outer annular edge surrounding a portion of said tubular cylindrical body and said external longitudinal wings, and a substantially planar face extending between said inner annular edge and said outer annular edge.

2. Spacing element according to claim 1, wherein said internal longitudinal wings have a substantially triangular cross-section.

3. Spacing element according to claim 1, wherein said external longitudinal wings have a substantially triangular cross-section.

4. Spacing element according to claim 1, wherein said inner annular edge and said outer annular edge of said frustum-shaped annular flange are inclined with respect to said substantially planar face.

5. Spacing element according to claim 1, comprising at least four internal longitudinal wings regularly spaced apart on said internal annular cylinder surface.

6. Spacing element according to claim 5, comprising at least four external longitudinal wings regularly spaced apart on said external annular cylinder surface.

7. Spacing element for dowel anchoring devices for fixing covering slabs to walls, said spacing element comprising;

a tubular cylindrical body made of plastic material and defining one end, an opposite end, a median region, an internal annular cylinder surface and an external annular cylinder surface;

at least four regularly spaced external longitudinal wings connected to said external annular surface, said external longitudinal wings having a substantially triangular cross-section and extending from said median region to said one end;

at least four regularly spaced internal longitudinal wings connected to said internal annular surface, said internal longitudinal wings having a substantially triangular cross-section and extending from said median region to said opposite end;

a frustum-shaped annular flange extending outwardly from said one end at an acute angle with respect to said cylindrical body, said frustum-shaped annular flange including an inner annular edge connected to said one end of said cylindrical body, an outer annular edge surrounding a portion of said tubular cylindrical body and said external longitudinal wings, and a substantially planar face extending between said inner annular edge and said outer annular edge, said inner annular edge and said outer annular edge being inclined with respect to said substantially planar face.

* * * * *